United States Patent [19]

Burton et al.

[11] 4,210,544

[45] Jul. 1, 1980

[54] DUAL PURPOSE CUTTING OIL COMPOSITION

[75] Inventors: James R. Burton, Groves; Vernon W. Cantwell, Port Neches, both of Tex.; James E. Davis, Summerville, S.C.

[73] Assignee: Texaco Inc., White Plains, N.Y.

[21] Appl. No.: 715,356

[22] Filed: Aug. 18, 1976

[51] Int. Cl.[2] ..... C10M 3/26

[52] U.S. Cl. ..... 252/47.5; 252/48.4; 252/394

[58] Field of Search ..... 260/302 SN; 252/47.5

[56] References Cited

U.S. PATENT DOCUMENTS

| | | | |
|---|---|---|---|
| 2,719,125 | 9/1955 | Roberts | 260/302 SD X |
| 2,736,729 | 2/1956 | Hrzikalla et al. | 260/302 SD |
| 2,836,564 | 5/1958 | Roberts et al. | 260/302 SD X |
| 3,929,652 | 12/1975 | Seni et al. | 252/47.5 X |
| 3,977,986 | 8/1976 | Conte, Jr. | 252/47.5 X |

FOREIGN PATENT DOCUMENTS

| | | | |
|---|---|---|---|
| 2113861 | 5/1973 | Fed. Rep. of Germany | 252/47.5 |
| 2434657 | 2/1975 | Fed. Rep. of Germany | 252/47.5 |

*Primary Examiner*—Delbert E. Gantz
*Assistant Examiner*—J. V. Howard
*Attorney, Agent, or Firm*—Carl G. Ries; Robert A. Kulason; Henry W. Archer

[57] ABSTRACT

Described are dual purpose cutting oils which serve as heavy duty cutting oils and machine lubricants in automatic screw machines. The oils comprise a base oil, a combination of extreme pressure agents comprising primarily a di-tertiary alkyl polysulfide, a chlorinated paraffin, and a copper corrosion inhibitor comprising a sulfur scavenger such as a 2,5-bis(n-alkyldithio)-thiadiazole.

8 Claims, No Drawings

DUAL PURPOSE CUTTING OIL COMPOSITION

BACKGROUND OF THE INVENTION

1. Field of the Invention

The invention pertains to the field of cutting oils.

Metal cutting and grinding have as their objective a progressive removal of metal from the work piece in the form of chips rather than by plastic reforming of the metal. In the field of metal cutting, the use of single and multiple point tools is well known and a great deal of metal working lubricant is used in the metal cutting process. In general, two types of lubricants are needed; a metal cutting lubricant and a machine oil. The cutting oil serves to remove heat generated during machining of the metal and lubricates the cutting tool against the work and chips. The machine oil lubricates the machine parts.

Cutting oils are generally paraffinic or intermediate base mineral oils. These are preferred because such products generally create less fog or smoke than naphthene oil. In severe conditions, which are more normal than not in heavy duty operations, it may be necessary to use an additive package in the cutting oil. This package will comprise extreme pressure additives cooper corrosion inhibitors, oxidation inhibitors, anti-mist agents, odorants to mask or remove the odors of other additives and other additives for special situations.

It is desirable when considering cutting oils and machine lubricants to think in terms of using one oil for both purposes. The use of a single oil rather than two or more has many advantages including reduced lubricant stock inventory and removal of the effects of cross-contamination of cutting oil and machine lubricant. Although dual purpose cutting oil formulations have been used in automatic screw machines for several years, these formulations often cannot be used in heavy duty cutting operations. Conversely, it is known that heavy duty cutting oil cannot normally be used as machine lubricants since in general they are unsatisfactory in copper corrosion characteristics.

2. Statement of the Prior Art

The prior art to which this invention relates is aware; inter alia, of the following patents: U.S. Pat. Nos. 3,459,663; 3,816,311; 3,853,638.

A more relevant patent is coassigned U.S. Pat. No. 3,929,652 which discloses a dual purpose oil comprising a major amount of a base oil and minor amounts of Bis(B-chlorophenethyl) disulfide and of an alkyl derivative of 2,5-di-mercapto-1,3,4-thiadizole. The compositions of the present invention constitute an improvement over the aforesaid oil in providing superior performance in severe machining operations and not requiring an odor masking agent.

SUMMARY OF THE INVENTION

The invention is a lubricant which is useful as both a cutting oil and a machine lubricant which comprises a major amount of a base oil and minor amounts of ditertiary alkylpolysulfide, chlorinated paraffin, and a 2,5-bis(n-alkyldithio)thiadiazole.

DESCRIPTION OF THE PREFERRED EMBODIMENTS

The dual purpose oil of the invention comprises a base oil with an additive package. The unique combination of additives in the oil was arrived at after many failures of so called equivalent additives on other combinations. Thus, other combinations attempted failed even though the additive package consisted of additives known in the art. The unsuccessful formulations showed that when used together, many additives interact with each other unpredictably or tended to ruin the properties of the oil in some way.

Base Oil

The base oil can be any kind of low dielectric constant oil which is inert to the additives and is of lubricating viscosity.

In fact, usually 80% or more of the oil consists of a base oil which may be a paraffinic oil of from about 90 to 190 SUS/100° F. viscosity and preferably 135 to 145 SUS/100° F. viscosity. It is also acceptable to use a combination of two or more oils as a base oil wherein one oil may range from about 80 to 120, and preferably from about 85 to 105 SUS/100° F. viscosity and the other oil may range from 150 to 220 and preferably from about 175 to 190 SUS/100° F. viscosity. Paraffinic or intermediate base mineral oils are generally preferred as a base oil in this invention since they generate less fog and smoke than a naphthene oil.

An extreme pressure agent is needed in the dual purpose cutting oil of the invention. The extreme pressure additives useful in the invention are alkyl polysulfides and chlorinated paraffin. The preferred additives are a combination of alkyl polysulfide and chlorinated paraffin.

According to a preferred embodiment of the invention, the extreme pressure additives are a di-tertiary alkyl polysulfide and a chlorinated paraffin. A particularly preferred extreme pressure combination comprises primarily ditertiary nonyl polysulfide and chlorinated wax. These additives each are present in amounts ranging from 0.5 to 10 weight percent and preferably from about 1.0 to 5.0 weight percent of the total oil. In view of the chemically active nature of this extreme pressure additive combination, it is necessary to include a copper corrosion inhibitor to prevent corrosion of machine parts by the dual purpose oil. The particular corrosion inhibitor used in this invention is a sulfur scavenger-type consisting of a 2,5-bis(n-alkyldithio)thiadiazole, wherein the alkyl substituent has from 5 to 12 carbon atoms. This additive is present in amounts varying from 0.01 to 1 weight percent and preferably from about 0.05 to 0.3 weight percent of the total oil. The oxidation inhibitor may be selected from those known in the art. A great many oxidation inhibitors are available commercially and many are hindered phenols although other types may be acceptable. Several of these are suitable in the dual purpose cutting oil of the invention. However, it is preferred that tertiary butyl phenol or 4-methyl-2,6-ditertiary butyl phenol be used in amounts ranging from about 0.5 to 1.0 weight percent and preferably 0.1 to 0.5 weight percent.

Although the base oil and the three additives mentioned above will provide an acceptable dual purpose cutting oil, it is preferred that other additives be used to provide additional properties which enhance the desirability of the dual purpose cutting oil. It is particularly preferred that a rust inhibitor be used. It is particularly preferred that a combination of the extreme pressure agent and a copper corrosion inhibitor be combined with a rust inhibitor comprising a mixture of alkenylsuccinic anhydride, phenol and lauryl acid phosphate. This three component additive system provides a particularly preferred cutting oil. The alkenyl succinic anhydride should be present in amounts ranging from about 0.01 to 1.0 weight percent and preferably from about 0.02 to 0.05 weight percent. The lauryl acid phosphate should be present in amounts ranging from about 0.001 to 0.01 weight percent and preferably from about 0.002 to 0.005 weight percent. The phenol should be present in amounts ranging from trace amounts to about 0.01 weight percent. The percentage of these components are only approximate and may be varied outside of the suggested ranges without departing from the scope of the invention.

An anti-mist additive is generally desirable and a few are known in the art. However, it is preferred in the cutting oil of the invention that a copolymer of ethylene and propylene be used. A particular preferred copolymer of ethylene and propylene has a molecular weight ranging from about 70,000 to 100,000 and a propylene content of from about 35 to 50 percent. This copolymer is usually used diluted with a paraffinic mineral oil. Preferably about 0.1 to 10.0 weight percent is used.

The compositions of the invention are light colored, low odor, medium viscosity cutting oils containing sulfur and chlorine EP agents and inhibited against rust, oxidation, copper corrosion and mechanically generated mist. They are designed to provide heavy duty machining performance and at the same time serve as a lubricant to machine parts without causing rust or corrosion. The composition and test data for a representative formulation ("C") are given in Table I.

The function of each component of the formulations is shown in Table II. Each component is used for a purpose for which it is known in the art as an individual additive. However, it was not known in the art that this specific combination of additives will function collectively to give in a single product all the performance properties claimed for the subject invention without undesirable effects such as malodor, corrosiveness or instability. It is not enough to put together a list of additives, each known in the art to impart a specific property. The additives must be compatible with each other and the base oil, they must complement each other and function together to give all the properties desired in the intended application. To illustrate this point and to show why the problem was not solved previously, a number of unsuccessful experimental dual purpose cutting oil compositions are listed in Table III below for comparison with "C". Commercial brands "X" and "Y" are included in the table since it was desired that the dual purpose cutting oil combine the good qualities of "X" with the high EP and machining capability of "Y". All these experimental compositions contain ingredients known in the art to impart qualities which added together might result in a satisfactory dual purpose cutting oil. Yet only "C" was satisfactory in all respects.

As indicated in Table III, mixture W, which contained sulfur and chlorine EP agents with a zinc dialkyldithiophosphate copper corrosion inhibitor, had the desired performance characteristics but developed an unacceptable haziness in storage due to some interaction of the additives.

Mixture "V" contained noncorrosive EP additives and did not require a copper corrosion inhibitor. However, the odor of "V" was considered objectionable to customers and the experimental product could not be marketed. The characteristic offensive odor of "V" was due to the EP additive. Extensive investigations were conducted in unsuccessful attempts to mask or neutralize the odor. No solution of the objectionable odor problem could be found.

In mixture "U" an attempt was made to develop a suitable product without malodours or corrosive sulfurized EP additives. A high EP level was achieved by using a relatively high concentration of a chlorinated EP additive. Mixture "U" appeared satisfactory in laboratory tests but gave unsatisfactory machining performance in a shop test.

It was thought that the problem had finally been solved with the formulation of "T" which contains a sulfur/chlorine EP additive, Car-A-Van 20/20. The corrosiveness of this additive was inhibited successfully with Amoco 150, and its mildly unpleasant odor was masked by oil of citronella. Mixture "T" gave excellent results in laboratory tests and a preliminary shop test was satisfactory. However, in more extensive shop testing, "T" did not give adequate performance in the more severe machining operations. Also some customers considered its odor objectionable.

Composition "C" solves the problems of the above experimental products and provides a single product having all the desired properties of a dual purpose cutting oil. "C" contains a combination of a highly effective, nonodorous sulfurized EP agent with chlorinated paraffin and a copper corrosion inhibitor. This combination provides adequate EP and machining properties without odor or corrosion problems. The other additives of "C" provide such desirable properties as anti-mist and anti-rust characteristics and oxidation resistance. Results to date have been very satisfactory, including excellent machining performance in at least one application in which "T" had failed.

To further illustrate the uniqueness of the combination of additives in "C", data are presented in Table IV, below comparing the copper corrosion characteristics of "C" with those of similar compositions in which Amoco 150 (an alkyl derivative of 2,5-dimercapto-1,3,4-thiadiazole) is substituted for the 2,5-bis(n-octyldithio)-thiadiazole. As shown by these data, "C" met the target requirements in the copper corrosion test while the formulations containing Amoco 150 failed these requirements and were no better than the uninhibited oil 7091, even though Amoco 150 is widely advertised as a copper corrosion inhibitor and is known to be effective in this property in some applications.

TABLE I

COMPOSITION AND TEST DATA FOR DUAL PURPOSE CUTTING OIL FORMULATION

| COMPOSITION | % VOLUME |
|---|---|
| Base Oil | |
| A | 48.16 |
| B | 51.84 |
| | 100.00 |
| **FINISHED OIL** | **% WEIGHT** |
| Base Oil | 91.367 |
| Di-tertiarynonylpolysulfide | 3.200 |
| Chlorinated Paraffin | 3.000 |
| Copper Corrosion Inhibitor | 0.100 |
| Anti-mist additive | 2.000 |
| Anti-rust concentrate | 0.033 |
| MDBP | 0.300 |
| **TEST RESULTS** | |
| Appearance | Pale, Blue Bloom |
| Odor | Mild, sulfurized mineral oil |
| Gravity, API | 26.9 |
| Flash, COC, °F. | 375 |
| Viscosity, SUS 100° F. | 159 |

TABLE I-continued

| COMPOSITION AND TEST DATA FOR DUAL PURPOSE CUTTING OIL FORMULATION | |
|---|---|
| SUS 210° F. | 44.2 |
| Viscosity Index | 106 |
| Color, ASTM D 1500 | L2.0 |
| Pour, °F. | +5 |
| Chlorine, % X-Ray | 1.16 |
| Sulfur, %-X-Ray | 1.23 |
| Copper, Strip Corrosion, ASTM D130 | |
| 6 hr a 160° F. | 1a |
| 4-Ball Wear, 1 hr. 75C, 600 RPM | |
| Scar, mm, 1 kg | 0.30 |
| 10 kg | 0.48 |
| 40 kg | 0.60 |
| Load Wear Index, ASTM D 2596, kg | 69.7 |
| Weld, kg | 398 |
| SAE Test, ST-205 lb 500 RPM | 550+ |
| 1000 RPM | 367 |
| Distilled Water Rust Test | |
| ST-90 (Procedure A) | Pass |
| Mist Test (Modified Woodward Air Release) | |
| Original Oil | Very good* |
| After Shearing 20 cycles | |
| FISST MS-103 | Good** |

*None to barely perceptible mist or fog.
**Very slight mist or fog.

TABLE II

| IDENTIFICATION AND CHEMICAL NATURE OF COMPONENTS OF FORMULATIONS OF TABLE I | | |
|---|---|---|
| COMPONENT | CHEMICAL NATURE | PURPOSE |
| A | Refined Paraffinic Pale Oil | Base Oil |

TABLE II-continued

| IDENTIFICATION AND CHEMICAL NATURE OF COMPONENTS OF FORMULATIONS OF TABLE I | | |
|---|---|---|
| COMPONENT | CHEMICAL NATURE | PURPOSE |
| B | 175–190 SUS/100° F. Viscosity Paraffinic Pale Oil 96–104 SUS/100° F. Viscosity | Base Oil |
| | Ditertiarynonyl polysulfide | EP Agent |
| | Chlorinated Paraffin | EP Agent |
| | 13 wt % copolymer of ethylene and propylene in paraffinic mineral oil diluent | Anti-mist additive |
| Anti-rust concentrate | Mixture of alkenylsuccinic anhydride, phenol and lauryl acid phosphate (90.91% of a 50% concentrate of hydrolized tetraphenyl succinic anhydride in Oil B. 7.58% lauryl acid phosphate 1.51% phenol) | Rust Inhibitor |
| MDBP | 4-methyl-2,6-ditertiarybutyl phenol | Oxidation Inhibitor |

TABLE III

COMPARISON OF EXPERIMENTAL CUTTING OILS AGAINST DUAL PURPOSE REQUIREMENTS

| Identification | X | Y | W | V | U | T | Invention | Target Quality Requirements For Purpose Cutting Oil |
|---|---|---|---|---|---|---|---|---|
| Composition, wt. % | | | | | | | | |
| Base Oil | 93.17[1] | 96.5[2] | 94.53[1] | 95.50[1] | 89.67[1] | 95.02[1] | 91.37[1] | |
| EP Agent | | | | | | | | |
| (Sulfur/Chlorine EP Agent) | | | | | | 2.50 | | |
| Sulfurized Di-isobutylene | | | 2.14 | | | | | |
| Di-tertiarynonyl polysulfide | | | | | | | 3.20 | |
| Chlorinated Paraffin | 4.50 | | 2.00 | 2.00 | 10.00 | | 3.00 | |
| (Sulfur/Chlorine EP Agent | | 1.5 | | | | | | |
| Sulfurized EP Agent | | | | 2.50 | | | | |
| Copper Corrosion Inhibitor | | | | | | | | |
| Zinc Dialkyl dithiophosphate | | | 1.33 | | | 0.10 | | |
| 2,5-bis(n-octyldithio)thiadiazole | | | | | | | 0.10 | |
| Oxidation Inhibitor | | | | | | | | |
| MDBP (See Table II) | 0.30 | | | | 0.30 | 0.30 | 0.30 | |
| Rust Inhibitor | | | | | | | | |
| Anti-rust concentrate (see Table II) | 0.03 | | | | 0.03 | 0.03 | 0.03 | |
| Anti-mist Agent (see Table II) | 2.00 | 2.0 | | | | 2.00 | 2.00 | |
| Odorant (oil of Citronella) | | | | | | 0.05 | | |
| Quality Characteristics | | | | | | | | |
| Odor | OK | OK | OK | Unacceptable | OK | Borderline | OK | Not objectionable |
| Stability | | | Unacceptable | OK | OK | OK | OK | Stable no separation or sediment |
| Copper Corrosion ASTM D130 | | | | | | | | |
| 6 Hr. at 160° F. | 1A | 4C | 1A | 1A | 1A | 1A | 1A | 1B Max. |
| EP Properties | | | | | | | | |
| SAE Test ST-205 Lbs at 500RPM | 482 | 437 | 480 | 417 | 500 | 452 | 500+ | Comparable to X |
| at 1000RPM | FAB[3] | 275 | 325 | 257 | 345 | 302 | 367 | Comparable to Y |
| Load Wear Index, KG | 33 | 75 | 51.5 | 59.0 | 47.2 | 81.3 | 69.7 | Comparable to Y |
| Machining Performance Level | Low | High | High | High | Low | Moderate | High | Comparable to Y |
| Other Properties | OK | OK | OK | OK | OK | OK | OK | Comparable to Y |

[1]Blends of Oil A and Oil B.
[2]An 18/82 blend of Oil B and a mineral oil sulfurized to a nominal 1.0% sulfur content.
[3]Fail at break in.

TABLE IV

COMPARISON OF COPPER CORROSION PROPERTIES OF "C" WITH SIMILAR COMPOSITIONS

| Identification | "C" | 7091 | 7093 | 7094 | Target Requirements |
|---|---|---|---|---|---|
| Composition, % wt. | | | | | |
| Oil A | 43.856 | 44.100 | 44.000 | 44.000 | |
| Oil B | 47.511 | 47.367 | 47.367 | 47.267 | |

TABLE IV-continued

COMPARISON OF COPPER CORROSION PROPERTIES OF "C" WITH SIMILAR COMPOSITIONS

| Identification | "C" | 7091 | 7093 | 7094 | Target |
|---|---|---|---|---|---|
| Ditertiarynonyl-polysulfide | 3.200 | 3.200 | 3.200 | 3.200 | |
| Chlorinated paraffin | 3.000 | 3.000 | 3.000 | 3.000 | |
| Anti-mist agent | 2.000 | 2.000 | 2.000 | 2.000 | |
| Anti-rust concentrate | 0.033 | 0.033 | 0.033 | 0.033 | |
| MDBP | 0.300 | 0.300 | 0.300 | 0.300 | |
| 2,5-bis(n-octyl dithio)thiadiazole | 0.100 | — | — | — | |
| Alkyl derivative of 2,5-dimercapto-1,3,4-thioadiazole (Amoco 150) | — | — | 0.100 | 0.200 | |
| Test Results | | | | | |
| Copper strip corrosion ASTM D130 (6 hr. at 160° F.) rating | 1a | 4c | 4c | 3b | 1b max. |

We claim:

1. A lubricating composition useful as a cutting oil comprising, in combination a major amount of a paraffinic base oil having a viscosity of about 90 to 190 SUS/100° F., 0.5 to 10 weight percent each of a di-tertiary alkyl polysulfide, and of a chlorinated paraffin and 0.01 to 1.0 weight percent of a 2,5-bis(n-alkyldithio)-thiadiazole.

2. A composition as in claim 1, wherein the polysulfide is present in an amount varying from 1.0 to 5.0 weight percent of the oil, the chlorinated paraffin is present in an amount ranging from about 1.0 to 5.0 weight percent and the thiadiazole is present in an amount ranging from about 0.5 to 0.3 weight percent.

3. An additive package for a cutting oil composition comprising from 0.5 to 10 percent by weight of a di-tertiary alkyl polysulfide; 0.5 to 10 percent by weight of a chlorinated paraffin and from 0.1 to 1.0 weight percent of a 2,5-bis-(n-alkyldithio)thiadiazole.

4. The package of claim 3, wherein said thiadiazole consists of 2,5-bis(n-octyldithio)thiadiazole in n-octyl disulfide.

5. The package of claim 3, containing also a rush inhibitor consisting of a mixture of an alkenyl succinic anhydride, phenol and lauryl acid phosphate.

6. The package of claim 3, containing also from 0.1 to 1.0 by weight percent of an oxidation inhibitor.

7. The package of claim 3, containing also from 0.1 to 10.0 weight percent of an anti-mist additive consisting of a copolymer of ethylene and propylene having a molecular weight of 70,000 to 100,000 and a propylene content ranging from about 35 to 50 percent.

8. The package of claim 5, wherein said anhydride is present in an amount ranging from about 0.001 to 1.0 weight percent; said lauryl acid phosphate is present in an amount of 0.001 to 0.01 weight percent; and said phenol is present in an amount ranging up to 0.01 weight percent.

* * * * *